US007239076B2

(12) United States Patent
Lee et al.

(10) Patent No.: US 7,239,076 B2
(45) Date of Patent: Jul. 3, 2007

(54) SELF-ALIGNED GATED ROD FIELD EMISSION DEVICE AND ASSOCIATED METHOD OF FABRICATION

(75) Inventors: Ji Ung Lee, Niskayuna, NY (US); Reed Roeder Corderman, Niskayuna, NY (US); William Hullinger Huber, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 279 days.

(21) Appl. No.: 10/670,487

(22) Filed: Sep. 25, 2003

(65) Prior Publication Data

US 2005/0067935 A1 Mar. 31, 2005

(51) Int. Cl.
*H01J 1/62* (2006.01)
*H01J 1/304* (2006.01)

(52) U.S. Cl. ..... 313/497; 313/495; 313/310; 313/311; 313/309; 445/24

(58) Field of Classification Search ..... 313/309, 313/311
See application file for complete search history.

(56) References Cited

U.S. PATENT DOCUMENTS 3,665,241 A 5/1972 Spindt et al.
3,755,704 A 8/1973 Spindt et al.
3,812,559 A 5/1974 Spindt et al.
5,229,331 A 7/1993 Doan et al.
5,266,530 A 11/1993 Bagley et al.

(Continued)

FOREIGN PATENT DOCUMENTS

EP 789382 A1 * 8/1997

(Continued)

OTHER PUBLICATIONS

G. Pirio et al., "Fabrication and Electrical Characteristics of Carbon Nanotube Field Emission Microcathodes with an Integrated Gate Electrode"; Institute of Physics Publishing, Nanotechnology, vol. 13, pp. 1-4, 2002.

(Continued)

*Primary Examiner*—Sikha Roy
(74) *Attorney, Agent, or Firm*—Fletcher Yoder

(57) ABSTRACT

A self-aligned gated field emission device and an associated method of fabrication are described. The device includes a substrate and a porous layer disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate. The device also includes a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer. The device further includes a gate dielectric layer disposed on the surface of the porous layer, wherein the gate dielectric layer is disposed between the plurality of substantially rod-shaped structures. The device still further includes a conductive layer selectively disposed on the surface of the gate dielectric layer, wherein the conductive layer is selectively disposed between the plurality of substantially rod-shaped structures.

106 Claims, 7 Drawing Sheets

U.S. PATENT DOCUMENTS

| | | | | |
|---|---|---|---|---|
| 5,372,973 | A | 12/1994 | Doan et al. | |
| 5,494,179 | A * | 2/1996 | Hori et al. | 216/11 |
| 5,726,524 | A * | 3/1998 | Debe | 313/309 |
| 6,278,231 | B1 * | 8/2001 | Iwasaki et al. | 313/310 |
| 6,339,281 | B2 | 1/2002 | Lee et al. | |
| 6,391,670 | B1 | 5/2002 | Wells et al. | |
| 6,394,871 | B2 | 5/2002 | Lee | |
| 6,504,292 | B1 * | 1/2003 | Choi et al. | 313/310 |
| 6,642,639 | B2 * | 11/2003 | Choi et al. | 313/309 |
| 6,709,929 | B2 * | 3/2004 | Zhang et al. | 438/268 |
| 6,710,538 | B1 * | 3/2004 | Ahn et al. | 313/497 |
| 6,729,923 | B2 * | 5/2004 | Ahn et al. | 445/24 |
| 6,769,945 | B2 * | 8/2004 | Chang et al. | 445/24 |
| 6,864,162 | B2 * | 3/2005 | Jin | 438/551 |
| 6,911,767 | B2 * | 6/2005 | Takai | 313/311 |
| 6,924,023 | B2 * | 8/2005 | Ohkura et al. | 428/138 |
| 2003/0143398 | A1 * | 7/2003 | Ohki et al. | 428/398 |

FOREIGN PATENT DOCUMENTS

| | | |
|---|---|---|
| WO | WO 2004/012218 | 2/2004 |
| WO | WO 2004/064101 | 7/2004 |

OTHER PUBLICATIONS

K.B.K. Teo et al., "Fabrication and Electrical Characteristics of Carbon Nanotube-based Microcathodes for Use in a Parallel Electron-Beam Lithography System"; J. Vac. Sci. Technol. B, vol. 21 (2), American Vacuum Society, pp. 693-697, 2003.

* cited by examiner

SELF-ALIGNED GATED ROD FIELD EMISSION DEVICE AND ASSOCIATED METHOD OF FABRICATION

STATEMENT REGARDING FEDERALLY SPONSORED RESEARCH AND DEVELOPMENT

The present invention was made with U.S. Government support under Contract No. 70NANB2H3030, awarded by the National Institute of Standards and Technology (NIST), Department of Commerce, and the U.S. Government may therefore have certain rights in the invention.

FIELD OF THE INVENTION

The present invention relates generally to field emission devices that are suitable for use in x-ray imaging applications, lighting applications, flat panel field emission display applications, microwave amplifier applications, electron-beam lithography applications and the like. More specifically, the present invention relates to a self-aligned gated rod field emission device and an associated method of fabrication.

BACKGROUND OF THE INVENTION

Electron emission devices, such as thermionic emitters, cold cathode field emitters and the like, are currently used as electron sources in x-ray tube applications, flat panel field emission display applications, microwave amplifier applications, electron-beam lithography applications and the like. Typically, thermionic emitters, which operate at relatively high temperatures and allow for relatively slow electronic addressing and switching, are used in x-ray imaging applications. It is desirable to develop a cold cathode field emitter that may be used as an electron source in x-ray imaging applications, such as computed tomography (CT) applications, to improve scan speeds, as well as in other applications. Moreover, applications such as low pressure gas discharge lighting and fluorescent lighting, which are limited by the life of the thermionic emitters that are typically used, will benefit from cold cathode field emitters.

Conventional cold cathode field emitters include a plurality of substantially conical or pyramid-shaped emitter tips arranged in a grid surrounded by a plurality of grid openings, or gates. The plurality of substantially conical or pyramid-shaped emitter tips are typically made of a metal or a metal carbide, such as Mo, W, Ta, Ir, Pt, $Mo_2C$, HfC, ZrC, NbC or the like, or a semiconductor material, such as Si, SiC, GaN, diamond-like C or the like, and have a radius of curvature on the order of about 20 nm. A common conductor, or cathode electrode, is used and a gate dielectric layer is selectively disposed between the cathode electrode and the gate electrode, forming a plurality of micro-cavities around the plurality of substantially conical or pyramid-shaped emitter tips. Exemplary cathode electrode materials include doped amorphous Si, crystalline Si and thin-film metals, such as Mo, Al, Cr and the like. Exemplary gate dielectric layer materials include $SiO_2$, $Si_3N_4$ and $Al_2O_3$. Exemplary gate electrode materials include Al, Mo, Pt and doped Si. When a voltage is applied to the gate electrode, electrons tunnel from the plurality of substantially conical or pyramid-shaped emitter tips.

The key performance factors associated with cold cathode field emitters include the emitter tip sharpness, the alignment and spacing of the emitter tips and the gates, the emitter tip to gate distance and the emitter tip density. For example, the emitter tip to gate distance partially determines the turn-on voltage of the cold cathode field emitter, i.e. the voltage difference required between the emitter tip and the gate for the cold cathode field emitter to start emitting electrons. Typically, the smaller the emitter tip to gate distance, the lower the turn-on voltage of the cold cathode field emitter and the lower the power consumption/dissipation. Likewise, the emitter tip density affects the footprint of the cold cathode field emitter.

Conventional cold cathode field emitters may be fabricated using a number of methods. For example, the Spindt method, well known to those of ordinary skill in the art, may be used (see U.S. Pat. Nos. 3,665,241, 3,755,704 and 3,812,559). Generally, the Spindt method includes masking one or more dielectric layers and performing a plurality of lengthy, labor-intensive etching, oxidation and deposition steps. Residual gas particles in the vacuum surrounding the plurality of substantially conical or pyramid-shaped emitter tips collide with emitted electrons and are ionized. The resulting ions bombard the emitter tips and damage their sharp points, decreasing the emission current of the cold cathode field emitter over time and limiting its operating life. Likewise, the Spindt method does not address the problem of emitter tip to gate distance. The emitter tip to gate distance is determined by the thickness of the dielectric layer disposed between the two. A smaller emitter tip to gate distance may be achieved by depositing a thinner dielectric layer. This, however, has the negative consequence of increasing the capacitance between the cathode electrode and the gate electrode, increasing the response time of the cold cathode field emitter. One or both of these shortcomings are shared by the other methods for fabricating conventional cold cathode field emitters as well, including the more recent chemical-mechanical planarization (CMP) methods (see U.S. Pat. Nos. 5,266,530, 5,229,331 and 5,372,973) and the more recent ion milling methods (see U.S. Pat. Nos. 6,391,670 and 6,394,871), all of which produce a plurality of substantially conical or pyramid-shaped emitter tips. Generally, optical lithography and other methods are limited to field openings on the order of about 0.5 microns or larger and emitter tip to gate distances on the order of about 1 micron or larger.

Thus, what is still needed is a simple and efficient method for fabricating a cold cathode field emitter that includes a plurality of emitter tips that are continuously sharp and that are self-aligned with their respective gates. What is also still needed is a method for fabricating a cold cathode field emitter that has a relatively small emitter tip to gate distance, providing a relatively high emitter tip density. This cold cathode field emitter should be suitable for use in x-ray imaging applications, lighting applications, flat panel field emission display applications, microwave amplifier applications, electron-beam lithography applications and the like.

BREIF SUMMARY OF THE INVENTION

The present invention provides a simple and efficient method for fabricating a cold cathode field emitter that includes a plurality of substantially cylindrical or rod-shaped emitter tips that are sharp and that are self-aligned with their respective gates. Each of the substantially cylindrical or rod-shaped emitter tips has a diameter on the order of about 20 nm. The present invention also provides a method for fabricating a cold cathode field emitter that has a relatively small emitter tip to gate distance, providing a relatively high emitter tip density. The emitter tip to gate distance is in the range of about 10 nm to about 50 nm and the emitter tip density is on the order of about $10^9$ emitter tips/$cm^2$. The cold cathode field emitter of the present invention is suitable for use in x-ray imaging applications, lighting applications, flat panel field emission display applications, microwave amplifier applications, electron-beam lithography applications and the like.

In one embodiment of the present invention, a method for fabricating a self-aligned gated field emission device includes providing a substrate having a surface and a predetermined thickness. The method also includes disposing a porous layer having a first surface and a first predetermined thickness on the surface of the substrate, wherein the porous layer defines a plurality of substantially cylindrical channels, the plurality of substantially cylindrical channels aligned substantially parallel to one another and substantially perpendicular to the surface of the substrate. The method further includes disposing a filler material within at least a portion of the substantially cylindrical channels defined by the porous layer to form a plurality of substantially rod-shaped structures. The method still further includes selectively removing a portion of the porous layer to form a second surface and a second predetermined thickness of the porous layer; disposing a gate dielectric layer having a surface and a predetermined thickness on the second surface of the porous layer and a portion of each of the plurality of substantially rod-shaped structures; and disposing a conductive layer having a predetermined thickness on the surface of the gate dielectric layer. Finally, the method includes selectively removing a portion of the conductive layer, the gate dielectric layer, and each of the plurality of substantially rod-shaped structures.

In another embodiment of the present invention, a method for fabricating a self-aligned gated field emission device includes providing a semiconductor layer having a surface and a predetermined thickness. The method also includes disposing an anodized aluminum oxide layer having a first surface and a first predetermined thickness on the surface of the semiconductor layer, wherein the anodized aluminum oxide layer defines a plurality of substantially cylindrical channels, the plurality of substantially cylindrical channels aligned substantially parallel to one another and substantially perpendicular to the surface of the semiconductor layer. The method further includes disposing a filler material within at least a portion of the substantially cylindrical channels defined by the anodized aluminum oxide layer to form a plurality of substantially rod-shaped structures. The method still further includes selectively removing a portion of the anodized aluminum oxide layer to form a second surface and a second predetermined thickness of the anodized aluminum oxide layer; disposing a gate dielectric layer having a surface and a predetermined thickness on the second surface of the anodized aluminum oxide layer and a portion of each of the plurality of substantially rod-shaped structures; and disposing a conductive layer having a predetermined thickness on the surface of the gate dielectric layer. Finally, the method includes selectively removing a portion of the conductive layer, the gate dielectric layer, and each of the plurality of substantially rod-shaped structures.

In a further embodiment of the present invention, a self-aligned gated field emission device includes a substrate having a surface and a predetermined thickness. The device also includes a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate. The device further includes a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer. The device still further includes a gate dielectric layer having a surface and a predetermined thickness disposed on the surface of the porous layer, wherein the gate dielectric layer is disposed between the plurality of substantially rod-shaped structures. Finally, the device includes a conductive layer having a predetermined thickness selectively disposed on the surface of the gate dielectric layer, wherein the conductive layer is selectively disposed between the plurality of substantially rod-shaped structures.

Another aspect of the present invention is to provide an electronic system having an emissive device, wherein the emissive device comprises at least one self-aligned gated field emission device as described herein.

DETAILED DESCRIPTION OF THE INVENTION

Figure 1:
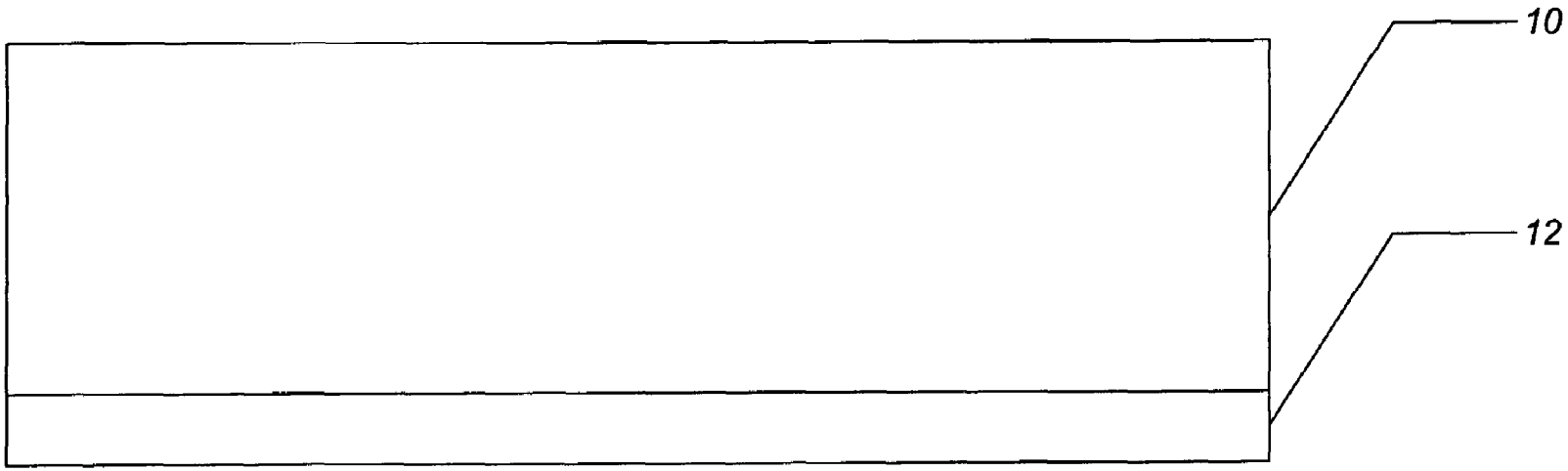
FIG. 1 is a sectional view illustrating a first step in the method for fabricating the self-aligned gated rod field emission device of the present invention.

Referring to FIG. 1, in one embodiment, the method for fabricating the self-aligned gated rod field emission device of the present invention first includes depositing a metal layer 10, such as a layer of Al, Ti, Mg, W, Zn, Zr, Ta, Nb or the like, on the surface of a semiconductor layer 12, such as a layer of Si or the like, the semiconductor layer 12 forming a substrate. Preferably, the metal layer 10 has a thickness of between about 0.1 microns and about 50 microns and the semiconductor layer 12 has a thickness of between about 1 micron and about 550 microns. The metal layer 10 is deposited on the surface of the semiconductor layer 12 using, for example, thermal evaporation, electron-beam evaporation, sputtering or the like. It should be noted that Al is the preferred metal layer 10 because it may be anodically oxidized to form a nanoporous structure. There is some experimental evidence that Ti may also be anodically oxidized to form a nanoporous structure. Mg, W, Zn, Zr, Ta and Nb (i.e. the so-called "valve metals") may be anodically oxidized to form a passivating oxide thin film and a nanoporous structure may, potentially, be formed. Additionally, the semiconductor layer 12 may also include a metal, such as Al, W, Nb or the like.

Figure 2:
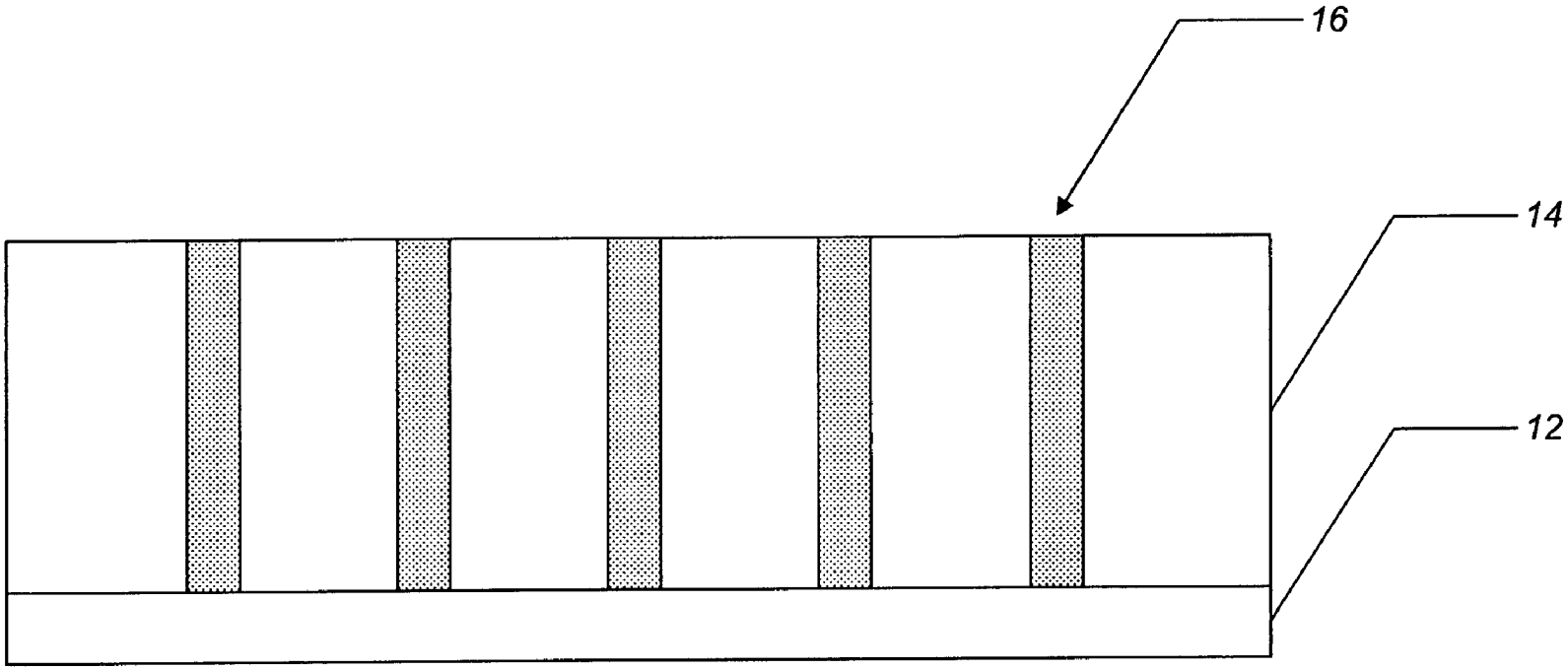
FIG. 2 is a sectional view illustrating a second step in the method for fabricating the self-aligned gated rod field emission device of the present invention.

Referring to FIG. 2, the aluminum (Al) forming the metal layer 10 is then anodized to form an anodized aluminum oxide (AAO) layer 14 having a plurality of highly-ordered, directionally-aligned pores 16 or channels. This process is well known to those of ordinary skill in the art and yields a plurality of pores 16 or channels that are substantially parallel and that each have a substantially cylindrical shape. Preferably, the diameter of each of the plurality of pores 16 or channels is between about 1 nm and about 1,000 nm, more preferably between about 5 nm and about 50 nm, and most preferably about 20 nm. The anodized aluminum oxide (AAO) layer 14 acts as a template layer in subsequent deposition and etching/milling steps. Generally, the anodized aluminum oxide (AAO) layer 14 is formed by applying an anodizing voltage to the aluminum (Al) in the presence of, for example, chromic acid, phosphoric acid, sulfuric acid or oxalic acid at a predetermined temperature, the Al-coated silicon substrate acting as an anode and a platinum (Pt) plate or the like acting as a cathode. To make the resulting pores 16 or channels more uniform, a method well known to those of ordinary skill in the art may be used. The anodized aluminum oxide (AAO) layer 14 is exposed to one or more acids, such as chromic acid, phosphoric acid, sulfuric acid, oxalic acid and/or the like, at a predetermined temperature to remove any undesired alumina remaining at the bottom of each pore 16 or channel and to increase the diameter of the resulting pores 16 or channels. Optionally, the anodized aluminum oxide (AAO) layer 14 is also annealed at a temperature of about 800 degrees C. to in order to enhance its hardness and density. The anodized aluminum oxide (AAO) layer 14 forms a first gate dielectric layer of the self-aligned gated rod field emission device of the present invention. To anneal the anodized aluminum oxide (AAO) layer 14, a stress-relief layer (not shown), such as an Nb layer or the like, is utilized in conjunction with the semiconductor layer 12. The stress-relief layer is deposited prior to the Al layer on the substrate. The Nb layer acts as a stress-relief layer since the thermal expansion coefficient of Nb is close to that of anodized aluminum oxide. Additionally, the bottom of the nanopores exhibit higher conductivity with the Nb layer present than that observed for anodized aluminum oxide on silicon with no Nb layer.

In one embodiment, the anodized aluminum oxide layer 14 is formed by first forming the metal layer 10 using mechanical deformation methods, such as, but not limited to, stamping, that are well known to those of ordinary skill in the art. In this embodiment, the metal layer 10 is molded from a metal sheet using a master stamp having a predetermined pattern, such as an order array that includes protrusions, such as at least one of convexes and pyramids. During anodization, which proceeds as previously described, the predetermined pattern formed by mechanical deformation acts as initiation points and guides the growth of channels in the oxide film.

In another embodiment, the anodized aluminum oxide layer 14 is formed using lithographic techniques. A thin layer of radiation sensitive resist, such as a photoresist or the like, is first applied to an Al or Al/Nb-coated silicon wafer. The radiation sensitive resist layer is then degraded to form an ordered configuration of small circular holes on the wafer. In one embodiment, degradation is achieved by exposing the radiation sensitive resist layer to at least one of ultraviolet (UV) radiation, heat, and an electron beam. Degradation of the radiation sensitive resist layer is followed by dissolution of the degraded radiation sensitive resist to expose selected areas of Al metal that are then anodized.

In a further embodiment, the anodized aluminum oxide layer 14 is formed by applying a thin layer of block copolymer (BCP) to an Al or Al/Nb-coated silicon wafer. The BCP is mixed with a solvent and applied to the wafer. As the solvent evaporates, the BCP will solidify into a film and separate into two distinct phases: a matrix phase and a cylinder phase. The cylinder phase can be aligned perpendicular to the surface of the wafer through, for example, self-assembly, application of an electric field or the like. The solidified BCP is then cured using, for example, heat, radiation (such as, for example, ultraviolet (UV) radiation or infrared (IR) radiation) or the like. The cylindrical phase is ultimately degraded and removed from the matrix phase to provide an ordered configuration of small circular empty cylinders that expose selected area of the Al metal that are then anodized. In one embodiment, degradation and removal of the cylindrical phase is accomplished by dissolution.

Figure 3:
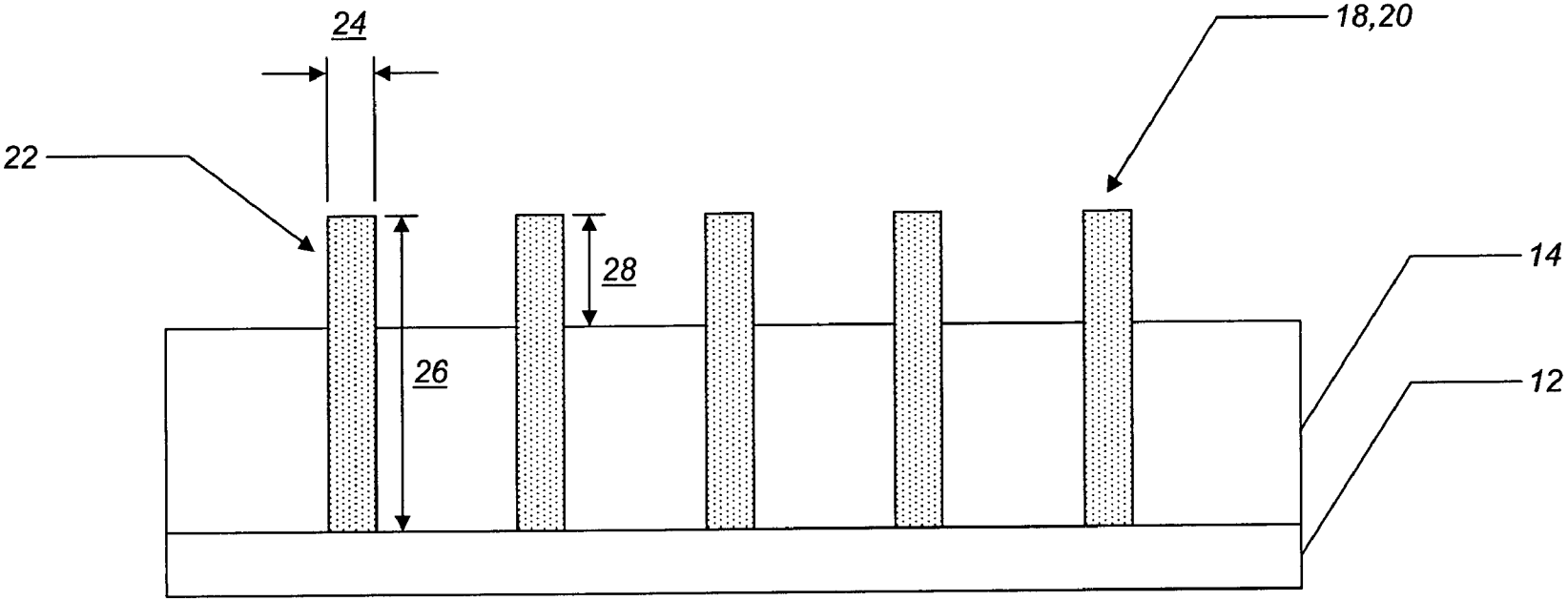
FIG. 3 is a sectional view illustrating a third step in the method for fabricating the self-aligned gated rod field emission device of the present invention.

Referring to FIG. 3, the plurality of pores 16 (FIG. 2) or channels are then filled with a metal 18, such as Pt, Mo, W, Ta or Ir, a carbide, such as $Mo_2C$, HfC, ZrC, TaC, WC, SiC or NbC, or the like, using electro-deposition combined with thermal reduction or the like. Alternatively, the plurality of pores 16 or channels are then filled using other methods, such as electrophoresis, chemical vapor deposition (CVD) and vapor-liquid-solid (VLS) chemical vapor deposition. Generally, the plurality pores 16 or channels are completely filled with the metal 18 and, if necessary, any excess metal 18 is lapped back. A portion of the anodized aluminum oxide (AAO) layer 14 is then etched using KOH, NaOH, TMAH, phosphoric acid or the like, exposing a portion 22 of each of the plurality of metal rod-shaped structures 20 disposed within each of the plurality of pores 16 or channels. The shape and alignment of each of the plurality of metal rod-shaped structures 20 substantially conforms to the shape and alignment of each of the plurality of pores 16 or channels. Thus, the plurality of metal rod-shaped structures 20 are substantially parallel and each has a substantially cylindrical shape. Preferably, the diameter 24 of each of the plurality of metal rod-shaped structures 20 is between about 1 nm and about 1,000 nm, more preferably between about 5 nm and about 30 nm, and most preferably about 20 nm. Preferably, the length 26 of each of the plurality of metal rod-shaped structures 20 is between about 0.1 microns and about 5 microns, of which a length 28 of between about 10 nm and about 1,000 nm protrudes beyond the surface of the anodized aluminum oxide (AAO) layer 14. Thus, the size of each of the plurality of metal rod-shaped structures 20 is on a nano-scale and each may be referred to as a "nano-rod."

Figure 4:
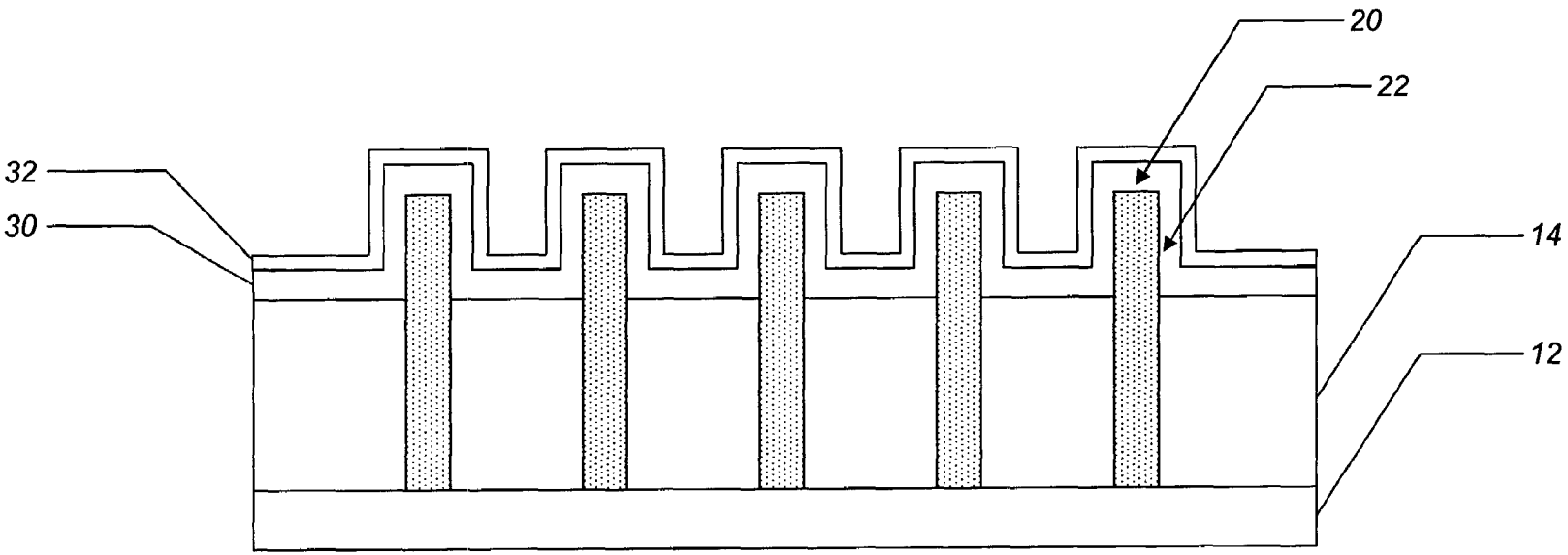
FIG. 4 is a sectional view illustrating a fourth step in the method for fabricating the self-aligned gated rod field emission device of the present invention.

Referring to FIG. 4, a second gate dielectric layer 30 is deposited on the surface of the anodized aluminum oxide (AAO) layer 14 and the surface of the protruding portion 22 of each of the plurality of metal rod-shaped structures 20. The gate dielectric layer 30 includes $SiO_2$, $SiN_x$, wherein $0.5 \leqq x \leqq .5$ (such as, but not limited to, SiN and $Si_3N_4$), $Al_2O_3$ or the like, and is deposited on the surface of the anodized aluminum oxide (AAO) layer 14 and the surface of the protruding portion 22 of each of the plurality of metal rod-shaped structures 20 using, for example, plasma-enhanced chemical vapor deposition (PECVD), low-pressure chemical vapor deposition (LPCVD) or any other deposition method that is suitable for conformally depositing the gate dielectric layer 30 on the protruding portion 22 of each of the plurality of nano-rods 20. Preferably, the thickness of the gate dielectric layer 30 is between about 1 nm and about 25 nm, and more preferably about 10 nm. The thickness of the gate dielectric layer 30 is selected to achieve a predetermined emitter tip to gate distance for the self-aligned gated rod field emission device of the present invention. It is desirable to minimize the emitter tip to gate distance because in operation, for a given voltage, a relatively larger electric field may be induced. After the gate dielectric layer 30 is deposited on the surface of the anodized aluminum oxide (AAO) layer 14 and the surface of the protruding portion 22 of each of the plurality of metal rod-shaped structures 20, a conductive layer 32, or gate electrode layer, is deposited on the surface of the gate dielectric layer 30 using, for example, sputtering or evaporation. The conductive layer 32 includes a metal, such as Nb, Pt, Al, W, Mo, Ti, Ni, Cr or the like, or a semiconductor material, such as highly-doped Si, GaN, GaAs, SiC or the like. Preferably, the conductive layer 32 has a thickness of between about 20 nm and about 100 nm.

Figure 5:
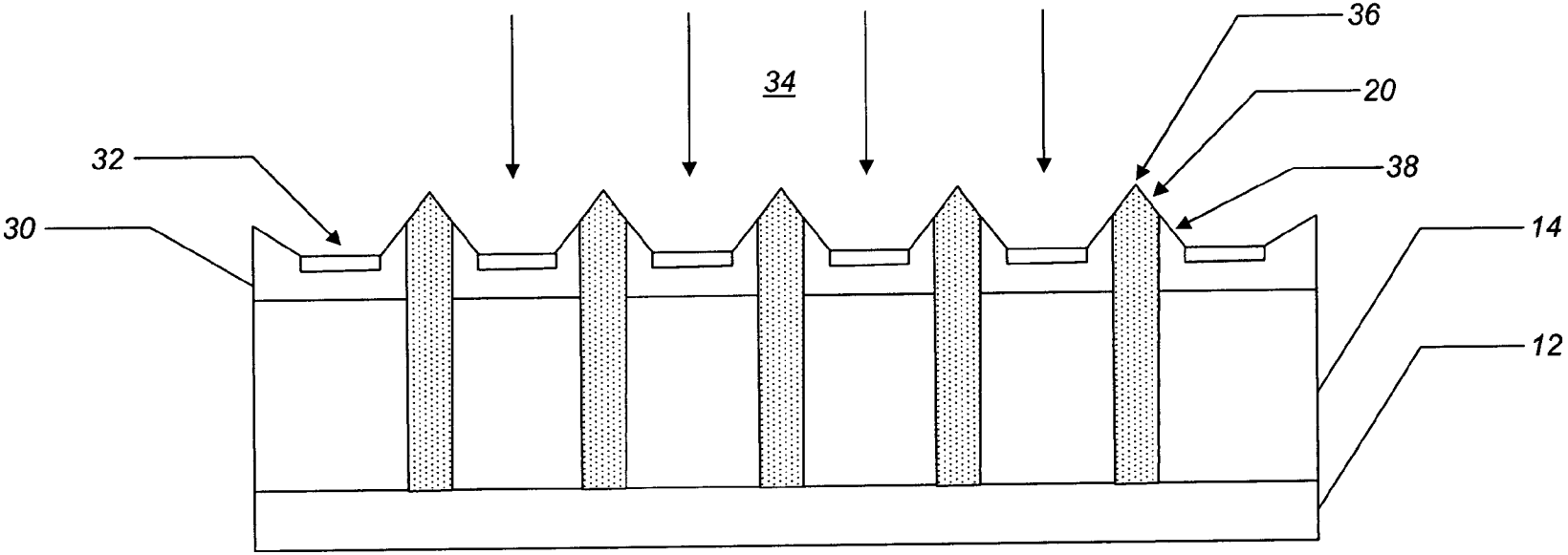
FIG. 5 is a sectional view illustrating a fifth step in the method for fabricating the self-aligned gated rod field emission device of the present invention.

Referring to FIG. 5, the resulting structure is ion milled using energetic ions 34, such as Ar+ ions or the like, at an angle substantially perpendicular to the surface of the structure. The ion milling rate is dependent not only upon the energy of the ions being used and the nature of the material being milled, but also upon the angle at which the ions bombard the surface. As a result, the ion milling rate is relatively higher in the substantially vertical regions adjacent to each of the plurality of metal rod-shaped structures 20 than it is in the substantially horizontal regions between each of the plurality of metal rod-shaped structures 20. Thus, the structure illustrated in FIG. 5 is formed, wherein the conductive layer 32 and the gate dielectric layer 30 are milled off of the top surface of each of the plurality of metal rod-shaped structures 20, the top surface of each of the plurality of metal rod-shaped structures 20 now forming a relatively sharp point. The conductive layer 32, or a portion thereof, remains in the substantially horizontal regions between each of the plurality of metal rod-shaped structures 20. A sloped region 38 of the gate dielectric layer 30 joins each of the remaining regions of conductive layer 32 with each of the plurality of metal rod-shaped structures 20. It should be noted that these ion milling/etching steps may be carried out simultaneously with the deposition of the gate dielectric layer 30 and the conductive layer 32. This is preferred when, as here, relatively small dimensions are involved.

Figure 6:
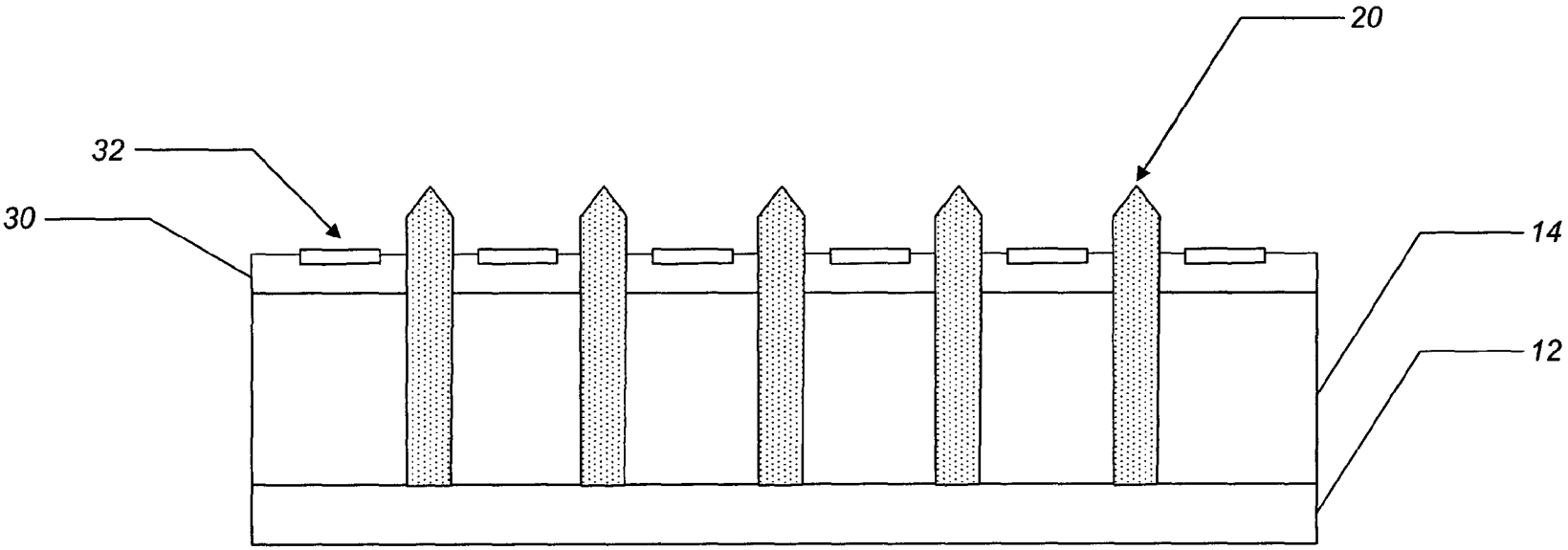
FIG. 6 is a sectional view illustrating a sixth step in the method for fabricating the self-aligned gated rod field emission device of the present invention.

Referring to FIG. 6, the final step in the method for fabricating the self-aligned gated rod field emission device of the present invention includes selectively etching the sloped regions 38 of the gate dielectric layer 30 to further expose each of the plurality of metal rod-shaped structures 20 and the remaining regions of conductive layer.

It should be noted that, in the embodiment described, ion milling is used to sharpen the tip of each of the plurality of nano-rods 20. However, if the diameter of each of the plurality of nano-rods 20 is sufficiently narrow, it is unnecessary to sharpen the tip of each of the plurality of nano-rods 20. In the embodiment described, the tip of each of the plurality of nano-rods 20 is also made to protrude beyond the level of the remaining regions of conductive layer 32, i.e. beyond the level of the gate. However, by carefully selecting the thickness of the gate dielectric layer 30 and the conductive layer 32, the height of the tip of each of the plurality of nano-rods 20 may be adjusted relative to the level of the gate such that the tip of each of the plurality of nano-rods 20 is substantially flush with the level of the gate.

Figure 7:
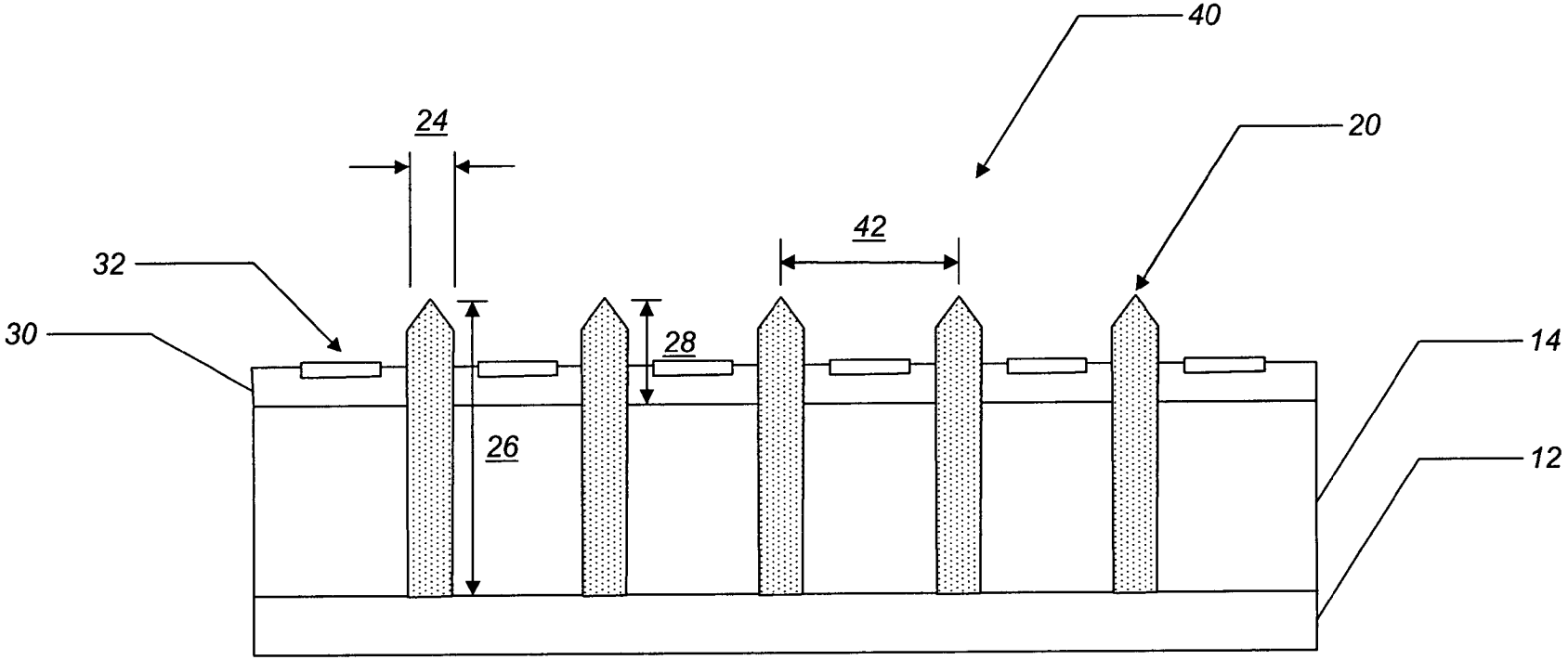
FIG. 7 is a sectional view illustrating the resulting self-aligned gated rod field emission device of the present invention.

Referring to FIG. 7, the resulting self-aligned gated rod field emission device 40 includes a plurality of nano-rods 20 disposed adjacent to the surface of a semiconductor layer 12 and partially within an anodized aluminum oxide (AAO) layer 14. As described above, each of the plurality of nano-rods 20 is made of a metal, such as Pt, Mo, W, Ta, Ir or the like, or a carbide, such as $Mo_2C$, HfC, ZrC, WC, TaC, SiC, NbC or the like, and has a substantially cylindrical shape. Preferably, each of the plurality of nano-rods 20 has a diameter 24 of between about 1 nm and about 1,000 nm, more preferably between about 5 nm and about 30 nm, and most preferably about 20 nm. Preferably, the length 26 of each of the plurality of nano-rods 20 is between about 0.05 microns and about 5 microns, of which a length 28 of between about 5 nm and about 900 nm protrudes beyond the surface of the anodized aluminum oxide (AAO) layer 14. The plurality of nano-rods 20 are aligned substantially parallel to one another and have a spacing 42 of between about 50 nm and about 500 nm, forming a plurality of gates. The anodized aluminum oxide (AAO) layer 14 has a thickness of between about 0.5 microns and about 5 microns. A gate dielectric layer 30 is disposed adjacent to the surface of the anodized aluminum oxide (AAO) layer 14 and a plurality of regions of conductive layer 32 are disposed adjacent to selected portions of the surface of the gate dielectric layer 30, between the plurality of nano-rods 20. Preferably, the thickness of the gate dielectric layer 30 is between about 1 nm and about 25 nm, and more preferably about 10 nm. Preferably, the thickness of the conductive layer 32 is between about 20 nm and about 100 nm. Thus, the tip to gate distance of the self-aligned gated rod field emitter device is between about 10 nm and about 50 nm and the emitter tip density is on the order of about $10^9$ emitter tips/$cm^2$.

In an alternative embodiment of the present invention, selected pores 16 (FIG. 2) or channels are filled with a dielectric material, rather than a metal. In one embodiment, the dielectric material comprises at least one oxide, such as, for example, TiO, $TiO_2$, ZnO, $ZrO_2$, $Al_2O_3$, $Nb_2O_5$, $Cr_2O_3$, $ZrTiO_4$, $ZrO_2$—$Al_2O_3$, $Al_2O_3$—$Cr_2O_3$, $Al_2O_3$—$TiO_2$, $TiO_2$—$RuO_2$, combinations thereof or the like. In one embodiment, the dielectric material is formed by first depositing a precursor in the pores 16 and reacting the precursor to form the dielectric material. After the subsequent steps described above are performed, the region formed by the dielectric material serves as an area where wire bonding may be made to the gate conducting region. Filling the wire bonding area with the dielectric material reduces leakage current through the unfilled pores and enhances reliability by preventing the pores from being contaminated and by reducing out-gassing.

The self-aligned gated field emission device of the present invention is suitable for use in a variety of applications, such as x-ray imaging applications, lighting applications, flat panel field emission displays, microwave amplifiers, electron-beam lithography applications and the like.

The present invention also includes electronic systems having an emissive device comprising at least one self-aligned gated field emission device as described herein. In one embodiment, the electronic system comprises an imaging system, such as, but not limited to, an x-ray imaging system or the like. In one particular embodiment, the imaging system is a computed tomography (CT) system. Other electronic systems that are within the scope of the present invention include x-ray sources, flat panel displays, microwave amplifiers, lighting devices, electron-beam lithography devices and the like. In one embodiment, the lighting device is one of a low pressure gas discharge lighting device and a fluorescent lighting device.

Although the present invention has been illustrated and described with reference to preferred embodiments and examples thereof, it will be readily apparent to those of ordinary skill in the art that other embodiments and examples may perform similar functions and/or achieve similar results. All such equivalent embodiments and examples are within the spirit and scope of the present invention and are intended to be covered by the following claims.

What is claimed is:

1. A method for fabricating a self-aligned gated field emission device, comprising:

providing a substrate having a surface and a predetermined thickness;

disposing a porous layer having a first surface and a first predetermined thickness on the surface of the substrate, wherein the porous layer defines a plurality of substantially cylindrical channels, the plurality of substantially cylindrical channels aligned substantially parallel to one another and substantially perpendicular to the surface of the substrate;

disposing a filler material within at least a portion of the substantially cylindrical channels defined by the porous layer to form a plurality of substantially rod-shaped structures, wherein the plurality of substantially rod-shaped structures comprises a material different from that of the substrate;

selectively removing a portion of the porous layer to form a second surface and a second predetermined thickness of the porous layer;

disposing a gate dielectric layer having a surface and a predetermined thickness on the second surface of the porous layer and a portion of each of the plurality of substantially rod-shaped structures;

disposing a conductive layer having a predetermined thickness on the surface of the gate dielectric layer; and selectively removing a portion of the conductive layer, the gate dielectric layer, and each of the plurality of substantially rod-shaped structures.

2. The method of claim 1, wherein the substrate comprises one of a semiconductor material and a metal.

3. The method of claim 2, wherein the semiconductor material comprises at least one of silicon, amorphous silicon, poly-silicon, silicon carbide and gallium nitride.

4. The method of claim 2, wherein the metal comprises at least one of Al, W and Nb.

5. The method of claim 1, wherein the thickness of the substrate is between about 1 micron and about 550 microns.

6. The method of claim 1, wherein the porous layer comprises an anodized metal oxide.

7. The method of claim 6, wherein the step of disposing the porous layer comprises:

providing a metal sheet;

mechanically deforming the metal sheet; and anodizing the metal sheet to form the anodized metal oxide.

8. The method of claim 7, wherein the step of mechanically deforming the metal sheet comprises molding the metal sheet using a master stamp having a predetermined pattern.

9. The method of claim 6, wherein the step of disposing the porous layer comprises:

applying a thin layer of block copolymer to the surface of the substrate, wherein the block copolymer comprises a matrix phase and a cylinder phase;

aligning the cylinder phase perpendicular to the surface of the substrate;

curing the block copolymer;

removing the cylinder phase from the matrix phase to provide an ordered configuration that exposes selected areas of a metal on the surface of the substrate; and anodizing the metal to form the anodized metal oxide.

10. The method of claim 6, wherein the step of disposing the porous layer comprises:

applying a radiation sensitive resist layer to the surface of the substrate;

degrading the radiation sensitive resist layer to form an ordered configuration of circular holes comprising degraded radiation sensitive resist in the radiation sensitive resist layer;

removing the degraded radiation sensitive resist to expose selected areas of a metal on the surface of the substrate; and anodizing the metal to form the anodized metal oxide.

11. The method of claim 10, wherein the step of degrading the radiation sensitive resist layer comprises exposing the radiation sensitive resist layer to at least one of ultraviolet radiation, x-rays and an electron beam.

12. The method of claim 6, wherein disposing the anodized metal oxide on the surface of the substrate comprises:

disposing a metal layer having a predetermined thickness on the surface of the substrate; and reacting the metal layer to form the anodized metal oxide.

13. The method of claim 12, wherein the metal layer comprises at least one of Al and Ti.

14. The method of claim 13, wherein the anodized metal oxide comprises at least one of anodized aluminum oxide and anodized titanium oxide.

15. The method of claim 12, wherein the thickness of the metal layer is between about 0.1 microns and about 50 microns.

16. The method of claim 6, wherein the step of disposing a metal layer having a predetermined thickness on the surface of the substrate comprises:

depositing a stress-relief layer on the surface of the substrate; and disposing a metal layer having a predetermined thickness on the stress-relief layer.

17. The method of claim 16, wherein the stress-relief layer comprises Nb.

18. The method of claim 1, wherein the first thickness of the porous layer is between about 0.5 microns and about 5 microns.

19. The method of claim 1, wherein each of the plurality of substantially cylindrical channels has a diameter of between about 1 nm and about 1,000 nm.

20. The method of claim 19, wherein each of the plurality of substantially cylindrical channels has a diameter of between about 5 nm and about 50 nm.

21. The method of claim 1, wherein each of the plurality of substantially cylindrical channels has a length of between about 0.1 microns and about 5 microns.

22. The method of claim 1, wherein the filler material comprises at least one of a metal, a carbide and a combination thereof.

23. The method of claim 22, wherein the filler material comprises at least one of Pt, Mo, W, Ta, Ir, $Mo_2C$, HfC, ZrC, TaC, WC, SiC and NbC.

24. The method of claim 1, wherein the filler material comprises a dielectric material.

25. The method of claim 24, wherein the dielectric material comprises at least one metal oxide.

26. The method of claim 25, wherein the at least one metal oxide comprises at least one of TiO, $TiO_2$, ZnO, $ZrO_2$, $Al_2O_3$, $Nb_2O_5$, $Cr_2O_3$, $ZrTiO_4$, $ZrO_2$—$Al_2O_3$, $Al_2O_3$—$Cr_2O_3$, $Al_2O_3$—$TiO_2$, $TiO_2$—$RuO_2$ and a combination thereof.

27. The method of claim 24, further comprising reacting the dielectric material to form a plurality of substantially rod-shaped insulating non-metallic contact structures.

28. The method of claim 1, wherein each of the plurality of substantially rod-shaped structures has a diameter of between about 1 nm and about 60 nm.

29. The method of claim 1, wherein each of the plurality of substantially rod-shaped structures has a length of between about 0.1 microns and about 5 microns.

30. The method of claim 1, wherein selectively removing a portion of the porous layer comprises etching the porous layer.

31. The method of claim 1, wherein the second thickness of the porous layer is between about 0.5 microns and about 5 microns.

32. The method of claim 1, wherein the gate dielectric layer comprises a material selected from the group consisting of $SiO_2$, $SiN_x$, wherein 0.5=x=1.5, and $Al_2O_3$.

33. The method of claim 1, wherein the thickness of the gate dielectric layer is between about 1 nm and about 25 nm.

34. The method of claim 1, wherein the conductive layer comprises a material selected from the group consisting of a metal and a semiconductor material.

35. The method of claim 34, wherein the metal comprises at least one of Nb, Pt, Al, W, Mo, Ti, Ni and Cr.

36. The method of claim 34, wherein the semiconductor material comprises at least one of Si, GaN, GaAs and SiC.

37. The method of claim 1, wherein the thickness of the conductive layer is between about 20 nm and about 100 nm.

38. The method of claim 1, wherein selectively removing a portion of the conductive layer, the gate dielectric layer, and each of the plurality of substantially rod-shaped structures comprises ion milling a portion of the conductive layer, the gate dielectric layer, and each of the plurality of substantially rod-shaped structures.

39. The method of claim 1, wherein the steps of disposing the conductive layer on the surface of the gate dielectric layer and selectively removing a portion of the conductive layer are performed simultaneously.

40. A method for fabricating a self-aligned gated field emission device, comprising:

providing a substrate comprising a semiconductor layer having a surface and a predetermined thickness;

disposing a porous layer comprising an anodized aluminum oxide layer having a first surface and a first predetermined thickness on the surface of the semiconductor layer, wherein the anodized aluminum oxide layer defines a plurality of substantially cylindrical channels, the plurality of substantially cylindrical channels aligned substantially parallel to one another and substantially perpendicular to the surface of the semiconductor layer;

disposing a filler material within at least a portion of the substantially cylindrical channels defined by the anodized aluminum oxide layer to form a plurality of substantially rod-shaped structures, wherein the plurality of substantially rod-shaped structures fills the plurality of substantially cylindrical channels and are in contact with the porous layer except for a portion that protrudes above the surface of the porous layer;

selectively removing a portion of the anodized aluminum oxide layer to form a second surface and a second predetermined thickness of the anodized aluminum oxide layer;

disposing a gate dielectric layer having a surface and a predetermined thickness on the second surface of the anodized aluminum oxide layer and a portion of each of the plurality of substantially rod-shaped structures;

disposing a conductive layer having a predetermined thickness on the surface of the gate dielectric layer; and selectively removing a portion of the conductive layer, the gate dielectric layer, and each of the plurality of substantially rod-shaped structures.

41. The method of claim 40, wherein the semiconductor layer comprises at least one of silicon, amorphous silicon, poly-silicon, silicon carbide and gallium nitride.

42. The method of claim 40, wherein the thickness of the semiconductor layer is between about 1 micron and about 550 microns.

43. The method of claim 40, wherein the first thickness of the anodized aluminum oxide layer is between about 0.5 microns and about 5 microns.

44. The method of claim 40, wherein disposing the anodized aluminum oxide layer on the surface of the semiconductor layer comprises:

disposing an aluminum layer having a predetermined thickness on the surface of the semiconductor layer; and reacting the aluminum layer to form the anodized aluminum oxide layer.

45. The method of claim 44, wherein the step of disposing an aluminum layer having a predetermined thickness on the surface of the substrate comprises:

depositing a stress-relief layer on the surface of the substrate; and disposing an aluminum layer having a predetermined thickness on the stress-relief layer.

46. The method of claim 45, wherein the stress-relief layer comprises Nb.

47. The method of claim 44, wherein the thickness of the aluminum layer is between about 0.5 microns and about 50 microns.

48. The method of claim 40, wherein each of the plurality of substantially cylindrical channels has a diameter of between about 1 nm and about 60 nm.

49. The method of claim 40, wherein each of the plurality of substantially cylindrical channels has a length of between about 0.5 microns and about 5 microns.

50. The method of claim 40, wherein the filler material comprises at least one of a metal, a carbide and a combination thereof.

51. The method of claim 50, wherein the filler material comprises at least one of Pt, Mo, W, Ta, Ir, $Mo_2C$, HfC, ZrC and NbC.

52. The method of claim 40, wherein the filler material comprises a dielectric material.

53. The method of claim 52, wherein the dielectric material comprises at least one of TiO, $TiO_2$, ZnO, $ZrO_2$, $Al_2O_3$, $Nb_2O_5$, $Cr_2O_3$, $ZrTiO_4$, $ZrO_2$—$Al_2O_3$, $Al_2O_3$—$Cr_2O_3$, $Al_2O_3$—$TiO_2$, $TiO_2$—$RuO_2$ and a combination thereof.

54. The method of claim 52, further comprising reacting the dielectric material to form a plurality of substantially rod-shaped metallic contact structures.

55. The method of claim 40, wherein selectively removing a portion of the anodized aluminum oxide layer comprises etching the anodized aluminum oxide layer.

56. The method of claim 55, wherein the step of disposing the porous layer comprises:

providing a metal sheet;

mechanically deforming the metal sheet; and anodizing the metal sheet to form the anodized metal oxide.

57. The method of claim 56, wherein the step of mechanically deforming the metal sheet comprises molding the metal sheet using a master stamp having a predetermined pattern.

58. The method of claim 55, wherein the step of disposing the porous layer comprises:

applying a thin layer of block copolymer to the surface of the substrate, wherein the block copolymer comprises a matrix phase and a cylinder phase;

aligning the cylinder phase perpendicular to the surface of the substrate;

curing the block copolymer;

removing the cylinder phase from the matrix phase to provide an ordered configuration that exposes selected areas of a metal on the surface of the substrate; and anodizing the metal to form the anodized metal oxide.

59. The method of claim 55, wherein the step of disposing the porous layer comprises:

applying a radiation sensitive resist layer to the surface of the substrate;

degrading the radiation sensitive resist layer to form an ordered configuration of circular holes comprising degraded radiation sensitive resist in the radiation sensitive resist layer;

removing the degraded radiation sensitive resist to expose selected areas of a metal on the surface of the substrate; and anodizing the metal to form the anodized metal oxide.

60. The method of claim 59, wherein the step of degrading the radiation sensitive resist layer comprises exposing the radiation sensitive resist layer to at least one of ultraviolet radiation, x-rays and an electron beam.

61. The method of claim 40, wherein the second thickness of the anodized aluminum oxide layer is between about 0.5 microns and about 5 microns.

62. The method of claim 40, wherein the dielectric layer comprises a material selected from the group consisting of $SiO_2$, $SiN_x$, wherein 0.5=x=1.5, and $Al_2O_3$.

63. The method of claim 40, wherein the thickness of the gate dielectric layer is between about 1 nm and about 25 nm.

64. The method of claim 40, wherein the conductive layer comprises a material selected from the group consisting of a metal and a semiconductor material.

65. The method of claim 64, wherein the metal comprises at least one of Nb, Pt, Al, W, Mo, Ti, Ni and Cr.

66. The method of claim 64, wherein the semiconductor material comprises at least one of Si, GaN, GaAs and SiC.

67. The method of claim 40, wherein the thickness of the conductive layer is between about 20 nm and about 100 nm.

68. The method of claim 40, wherein selectively removing a portion of the conductive layer, the gate dielectric layer, and each of the plurality of substantially rod-shaped structures comprises ion milling a portion of the conductive layer, the gate dielectric layer, and each of the plurality of substantially rod-shaped structures.

69. A self-aligned gated field emission device, comprising:

a substrate having a surface and a predetermined thickness;

a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate;

a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer, wherein the plurality of substantially rod-shaped structures comprises a material different from that of the substrate;

a gate dielectric layer having a surface and a predetermined thickness disposed on the surface of the porous layer, wherein the gate dielectric layer is disposed between the plurality of substantially rod-shaped structures; and a conductive layer having a predetermined thickness selectively disposed on the surface of the gate dielectric layer, wherein the conductive layer is selectively disposed between the plurality of substantially rod-shaped structures.

70. The device of claim 69, wherein the substrate comprises a material selected from the group consisting of a semiconductor material and a metal.

71. The device of claim 70, wherein the semiconductor material comprises at least one of silicon, amorphous silicon, poly-silicon, silicon carbide and gallium nitride.

72. The device of claim 70, wherein the metal comprises at least one of Al, W and Nb.

73. The device of claim 69, wherein the thickness of the substrate is between about 1 micron and about 550 microns.

74. The device of claim 69, wherein the porous layer comprises an anodized metal oxide.

75. The device of claim 74, wherein the anodized metal oxide comprises at least one of an anodized aluminum oxide and an anodized titanium oxide.

76. The device of claim 69, wherein the thickness of the porous layer is between about 0.5 microns and about 5 microns.

77. The device of claim 69, wherein each of the plurality of substantially cylindrical channels has a diameter of between about 1 nm and about 60 nm.

78. The device of claim 69, wherein each of the plurality of substantially cylindrical channels has a length of between about 0.5 microns and about 5 microns.

79. The device of claim 69, wherein each of the plurality of substantially rod-shaped structures comprises a metal.

80. The device of claim 79, wherein the metal comprises at least one of Pt, Mo, W, Ta, Ir, $Mo_2C$, HfC, ZrC and NbC.

81. The device of claim 69, wherein each of the plurality of substantially rod-shaped structures comprises a dielectric material.

82. The device of claim 81, wherein the dielectric material comprises at least one metal oxide.

83. The device of claim 82, wherein the at least one metal oxide comprises at least one of TiG, $TiO_2$, ZnO, $ZrO_2$, $Al_2O_3$, $Nb_2O_5$, $ZrTiO_4$, $ZrO_2$—$Al_2O_3$, $Al_2O_3$—$Cr_2O_3$, $Al_2O_3$—$TiO_2$, $TiO_2$—$RuO_2$ and a combination thereof.

84. The device of claim 69, wherein each of the plurality of substantially rod-shaped structures has a diameter of between about 1 nm and about 60 nm.

85. The device of claim 69, wherein each of the plurality of substantially rod-shaped structures has a length of between about 0.1 microns and about 5 microns.

86. The device of claim 69, wherein the gate dielectric layer comprises a material selected from the group consisting of $SiO_2$, $SiN_x$, wherein 0.5=x=1.5, and $Al_2O_3$.

87. The device of claim 69, wherein the thickness of the gate dielectric layer is between about 1 nm and about 25 nm.

88. The device of claim 69, wherein the conductive layer comprises a material selected from the group consisting of a metal and a semiconductor material.

89. The device of claim 88, wherein the metal comprises at least one of Nb, Pt, Al, W, Mo, Ti, Ni and Cr.

90. The device of claim 88, wherein the semiconductor material comprises at least one of Si, GaN, GaAs and SiC.

91. The device of claim 69, wherein the thickness of the conductive layer is between about 20 nm and about 100 nm.

92. The device of claim 69, wherein the plurality of substantially rod-shaped structures are separated by a distance of between about 50 nm and about 500 nm.

93. The device of claim 69, wherein the self-aligned gated field emission device is suitable for use in an application selected from the group consisting of an x-ray tube application, a flat panel field emission display application, a microwave amplifier application and an electron-beam lithography application.

94. The device of claim 69, wherein a first shape and alignment of the plurality of substantially rod-shaped structures substantially conforms to a second shape and alignment of the plurality of substantially cylindrical channels.

95. The device of claim 69, wherein the plurality of substantially rod-shaped structures fills the plurality of substantially cylindrical channels and are in contact with the porous layer except for the portion that protrudes above the surface of the porous layer.

96. An electronic system, the electronic system having an emissive device, the emissive device comprising at least one self-aligned gated field emission device, wherein the at least one self-aligned gated field emission device comprises:

a substrate having a surface and a predetermined thickness;

a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate;

a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer, wherein the plurality of substantially rod-shaped structures fills the plurality of substantially cylindrical channels and are in contact with the porous layer except for the portion that protrudes above the surface of the porous layer;

a gate dielectric layer having a surface and a predetermined thickness disposed on the surface of the porous layer, wherein the gate dielectric layer is disposed between the plurality of substantially rod-shaped structures; and a conductive layer having a predetermined thickness selectively disposed on the surface of the gate dielectric layer, wherein the conductive layer is selectively disposed between the plurality of substantially rod-shaped structures.

97. The electronic system of claim 96, wherein the electronic system is an imaging system.

98. The electronic system of claim 97, wherein the imaging system is an x-ray imaging system.

99. The electronic system of claim 96, wherein the electronic system is a lighting system.

100. The electronic system of claim 99, wherein the lighting system is one of a low pressure gas discharge lighting system and a fluorescent lighting system.

101. The electronic system of claim 96, wherein the electronic system comprises at least one of an x-ray source, a flat panel display, a microwave amplifier, a lighting device and an electron-beam lithography device.

102. The electronic system of claim 96, wherein a first shape and alignment of the plurality of substantially rod-shaped structures substantially conforms to a second shape and alignment of the plurality of substantially cylindrical channels.

103. The electronic system of claim 96, wherein the plurality of substantially rod-shaped structures comprises a material different from that of the substrate.

104. A self-aligned gated field emission device, comprising:

a substrate having a surface and a predetermined thickness;

a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate;

a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer, wherein each of the plurality of substantially rod-shaped structures comprises a dielectric material;

a gate dielectric layer having a surface and a predetermined thickness disposed on the surface of the porous layer, wherein the gate dielectric layer is disposed between the plurality of substantially rod-shaped structures; and a conductive layer having a predetermined thickness selectively disposed on the surface of the gate dielectric layer, wherein the conductive layer is selectively disposed between the plurality of substantially rod-shaped structures.

105. A self-aligned gated field emission device, comprising:

a substrate having a surface and a predetermined thickness;

a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate;

a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer, wherein the plurality of substantially rod-shaped structures fills the plurality of substantially cylindrical channels and are in contact with the porous layer except for the portion that protrudes above the surface of the porous layer;

a gate dielectric layer having a surface and a predetermined thickness disposed on the surface of the porous layer, wherein the gate dielectric layer is disposed between the plurality of substantially rod-shaped structures; and a conductive layer having a predetermined thickness selectively disposed on the surface of the gate dielectric layer, wherein the conductive layer is selectively disposed between the plurality of substantially rod-shaped structures.

106. An electronic system, the electronic system having an emissive device, the emissive device comprising at least one self-aligned gated field emission device, wherein the at least one self-aligned gated field emission device comprises:

a substrate having a surface and a predetermined thickness;

a porous layer having a surface and a predetermined thickness disposed adjacent to the surface of the substrate, wherein the porous layer defines a plurality of substantially cylindrical channels, each of the plurality of substantially cylindrical channels aligned substantially parallel to one another and substantially perpendicular to the surface of the substrate;

a plurality of substantially rod-shaped structures disposed within at least a portion of the plurality of substantially cylindrical channels defined by the porous layer and adjacent to the surface of the substrate, wherein a portion of each of the plurality of substantially rod-shaped structures protrudes above the surface of the porous layer, wherein the plurality of substantially rod-shaped structures comprises a material different from that of the substrate;

a gate dielectric layer having a surface and a predetermined thickness disposed on the surface of the porous layer, wherein the gate dielectric layer is disposed between the plurality of substantially rod-shaped structures; and a conductive layer having a predetermined thickness selectively disposed on the surface of the gate dielectric layer, wherein the conductive layer is selectively disposed between the plurality of substantially rod-shaped structures.

* * * * *